US007327327B2

(12) United States Patent
Wong et al.

(10) Patent No.: US 7,327,327 B2
(45) Date of Patent: Feb. 5, 2008

(54) OMNIDIRECTIONAL BROADBAND MONOPOLE ANTENNA

(75) Inventors: Kin-Lu Wong, Kaohsiung (TW); Chia-Lun Tang, Miaoli County (TW); Saou-Wen Su, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/945,046

(22) Filed: Sep. 21, 2004

(65) Prior Publication Data

US 2005/0243009 A1 Nov. 3, 2005

(30) Foreign Application Priority Data

Apr. 29, 2004 (TW) ..... 93111988 A

(51) Int. Cl.
*H01Q 9/38* (2006.01)

(52) U.S. Cl. ..... 343/829; 343/900; 343/895

(58) Field of Classification Search ..... 343/829
See application file for complete search history.

(56) References Cited

U.S. PATENT DOCUMENTS

| | | | | |
|---|---|---|---|---|
| 4,466,003 | A | 8/1984 | Royce | |
| 4,644,366 | A * | 2/1987 | Scholz | 343/895 |
| 5,828,340 | A | 10/1998 | Johnson | |
| 6,339,409 | B1 | 1/2002 | Warnagiris | |
| 6,421,014 | B1 * | 7/2002 | Sanad | 343/700 MS |
| 6,567,053 | B1 * | 5/2003 | Yablonovitch et al. | 343/767 |
| 6,650,303 | B2 * | 11/2003 | Kim et al. | 343/895 |
| 6,710,748 | B2 * | 3/2004 | Yarasi et al. | 343/702 |
| 6,816,127 | B2 * | 11/2004 | McKivergan et al. | 343/895 |
| 6,856,286 | B2 * | 2/2005 | Jo et al. | 343/700 MS |
| 2002/0015000 | A1 * | 2/2002 | Reece et al. | 343/795 |
| 2003/0048234 | A1 * | 3/2003 | Alexopoulos et al. | 343/895 |
| 2003/0117325 | A1 * | 6/2003 | Jo et al. | 343/702 |
| 2004/0155832 | A1 * | 8/2004 | Yuanzhu | 343/895 |

OTHER PUBLICATIONS

Ammann et al. "Wideband monopole antennas for multi-band wireless systems", IEEE Antennas and Propagation magazine, vol. 45, No. 2, Apr. 2003.

Anob et al. "Wideband orthogonal square monopole antennas with semi-circular base", 2001 IEEE Antennas Propagat. Soc. Int. Symp. Dig., Boston, MA, pp. 294-297.

* cited by examiner

*Primary Examiner*—Wilson Lee
*Assistant Examiner*—Binh V Ho
(74) *Attorney, Agent, or Firm*—Birch, Stewart, Kolasch & Birch, LLP

(57) ABSTRACT

An omnidirectional broadband monopole antenna comprises a ground plane, a radiating member, and a feed member. The ground plane is made of a metal plate. The radiating member comprises a first sub-radiating member, a second sub-radiating member connected to one side of the first sub-radiating member to provide a first angle therebetween, and a third radiating member connected to another side of the first sub-radiating member opposite the second sub-radiating member; a second angle is provided by the first and third sub-radiating members. The feed member is made of a metal rod with one end connected to the radiating member and the other to a signal source. Gain variations of the antenna's horizontal radiation pattern across the operating bandwidth are less than 3 dB.

20 Claims, 12 Drawing Sheets

OMNIDIRECTIONAL BROADBAND MONOPOLE ANTENNA

BACKGROUND

This Non-provisional application claims priority under 35 U.S.C. § 119(a) on Patent Application No(s). 093111988 filed in Taiwan, Republic of China on Apr. 29, 2004, the entire contents of which are hereby incorporated by reference.

The present invention relates to a broadband monopole antenna, and in particular to an antenna with omnidirectional horizontal radiation.

For higher wireless transmission rates, a broadband antenna is popularly used, especially those capable of providing omnidirectional radiation. Recently, planar metal-plate monopole antennas are frequently used. Although frequency ratios over 1:3 are available, omnidirectional radiation characteristics (e.g. radiation pattern) thereof are unstable, generally decreasing with operating frequency. This behavior is mainly because, for achieving a very wide impedance bandwidth, the planar metal-plate monopole is usually designed to be with a large width, which is usually comparable to or larger than a quarter-wavelength of the highest operating frequency in the impedance bandwidth. In this case, due to the path-length difference caused by the large monopole width, the antenna's radiated fields contributed from the excited surface currents near the two side edges of the planar monopole will be destructive in the direction parallel to the planar monopole. On the other hand, the radiated fields in the direction normal to the planar monopole in general have no path-length difference and will be constructive. This behavior will lead to poor omnidirectional radiation characteristics for the conventional planar monopole antenna.

U.S. Pat. No. 4,466,003 discloses a conventional monopole antenna comprising several metal rods of various lengths creating various resonance frequencies. However, this monopole antenna is oversized and presents a complicated configuration.

A broadband monopole antenna disclosed in U.S. Pat. No. 5,828,340 increases 40% of the operation bandwidth, but cannot satisfy commercial requirement.

U.S. Pat. No. 6,339,409 discloses a helical antenna formed by a right-angle triangular conductive plate. Although wider bandwidth is available, this antenna presents an even more complicated structure.

SUMMARY

Embodiments of the invention provide a broadband monopole antenna with gain variation in horizontal radiation pattern less than 3 dB across all operating frequencies in bandwidth thereof.

An omnidirectional broadband monopole antenna of embodiments of the invention comprises a ground plane with a via-hole, a radiating member disposed thereabove comprising a plurality of sub-radiating members to provide angles with a feed member connected to the radiating member.

The radiating member comprises a first sub-radiating member having a first side and a second side opposite thereto, a second sub-radiating member connected to the first side extending in a first direction, and a third sub-radiating member connected to the second side, extending in a second direction.

The angled configuration of the radiating member comprising the first, second, and third sub-radiating members is generated by bending a metal plate, or by combining at least two metal plates.

The feed member can be a metal rod with one end connected to a feed point on the first radiating member through a via-hole in the ground plane.

The first sub-radiating member and the second radiating member provide a first angle, and the first sub-radiating member and the third radiating member provide a second angle. By adjusting the first and second angles between 40° and 130°, gain variation of the horizontal radiation pattern can be less than 3 dB.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

First Embodiment

Figure 1A:
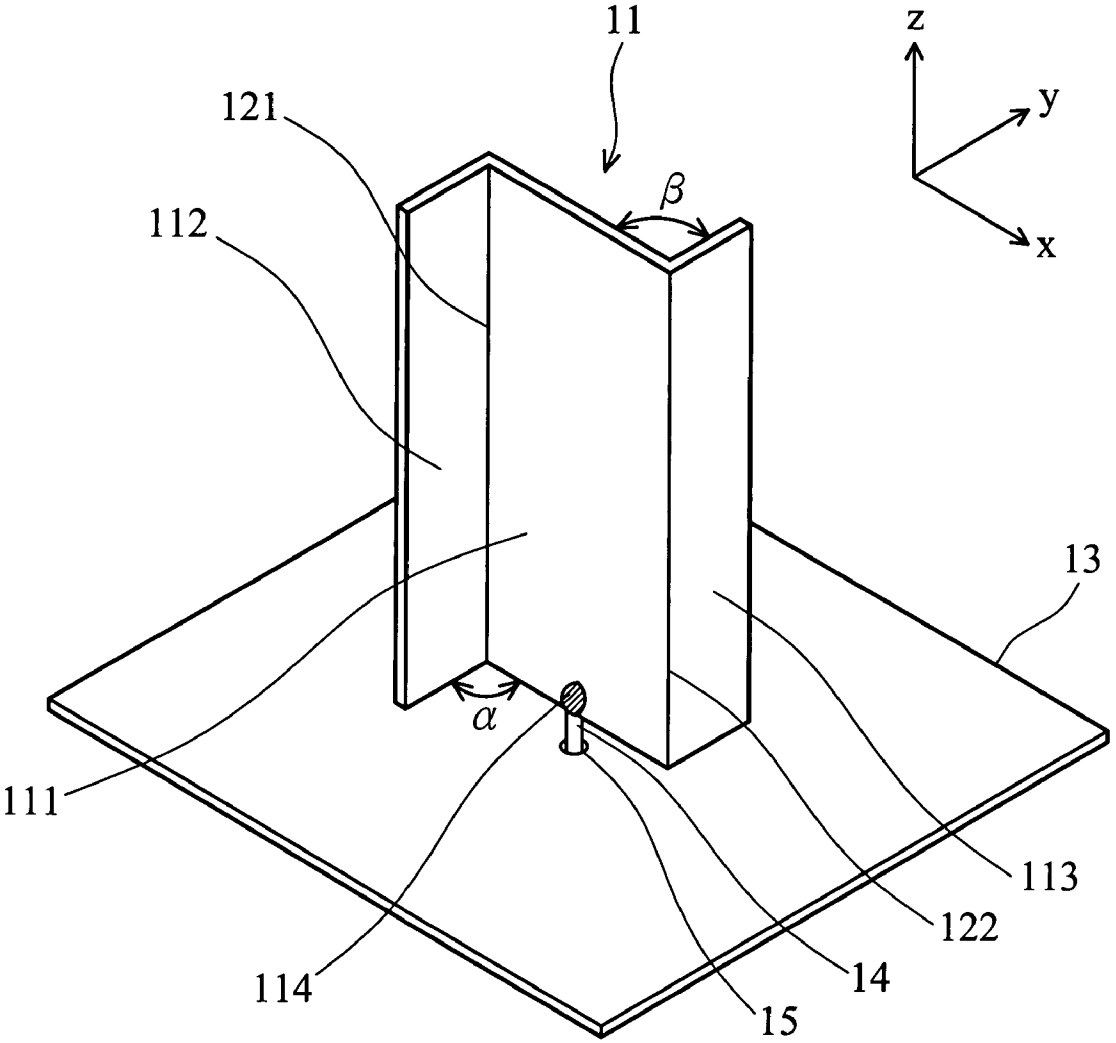
FIG. 1*a* is a perspective view of an omnidirectional broadband monopole antenna of the first embodiment of the invention.
Figure 1B:
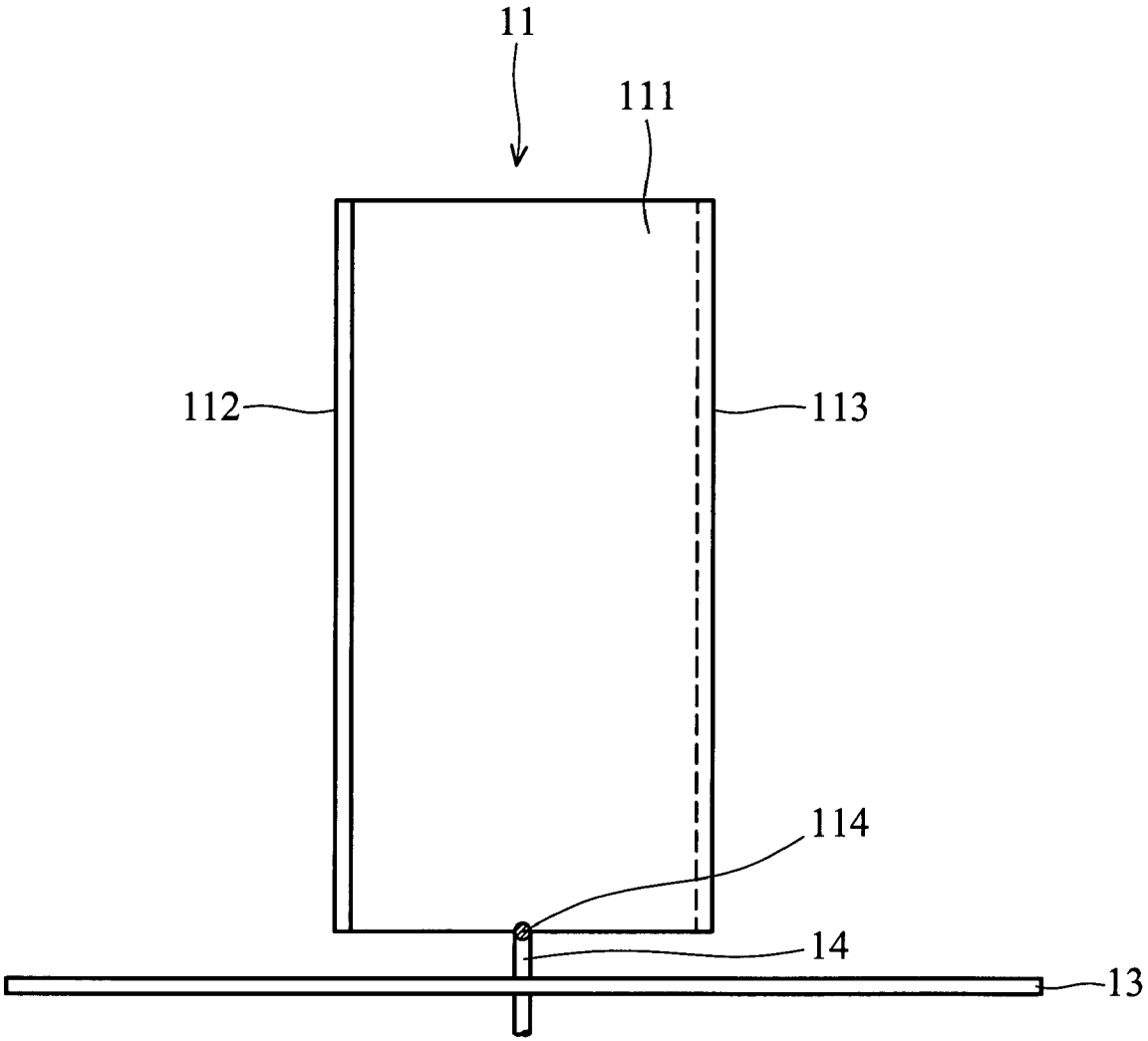
FIG. 1*b* is a front view of an omnidirectional broadband monopole antenna of a first embodiment of the invention.

An omnidirectional broadband monopole antenna of the first embodiment of the invention is shown in FIGS. 1*a* and 1*b*, comprising a radiating member 11, a ground plane 13 and a feed member 14. The radiating member 11 comprises a first sub-radiating member 111, a second sub-radiating member 112 and a third sub-radiating member 113, which are perpendicular to the around plate 13. The radiating member 11 has a first side 121 and a second side 122 opposite thereto. The second sub-radiating member 112 is connected to the first side 121, forming a first angle α. The third sub-radiating member 113 is connected to the second side 122, forming a second angle β substantially equal to the first angle α. Both the second and third sub-radiating members 112, 113 have the same planar shape, however, the second sub-radiating member 112 extends opposite to the third sub-radiating member 113.

The radiating member 11 can be formed by angling a metal plate to the configuration of the first, second and third sub-radiating members, or by combining (e.g. welding) two metal plates.

The ground plane 13 with a via-hole 15 comprises a metal plate. The feed member 14 is a metal rod with one end connected to a feed point 114 on the first sub-radiating member 111 via the via-hole 15 with the other end connecting to a signal source (not shown), without contacting the via-hole 15.

To obtain good omnidirectional radiation (gain variation in horizontal-plane radiation less than 3 dB), the first and second angles α and β are preferably between 40° and 130°. In this case the effective monopole width is greatly decreased, and thus the possible path-length difference caused by the monopole width is also greatly reduced. This behavior results in improved omnidirectional radiation for the proposed invention.

Figure 2:
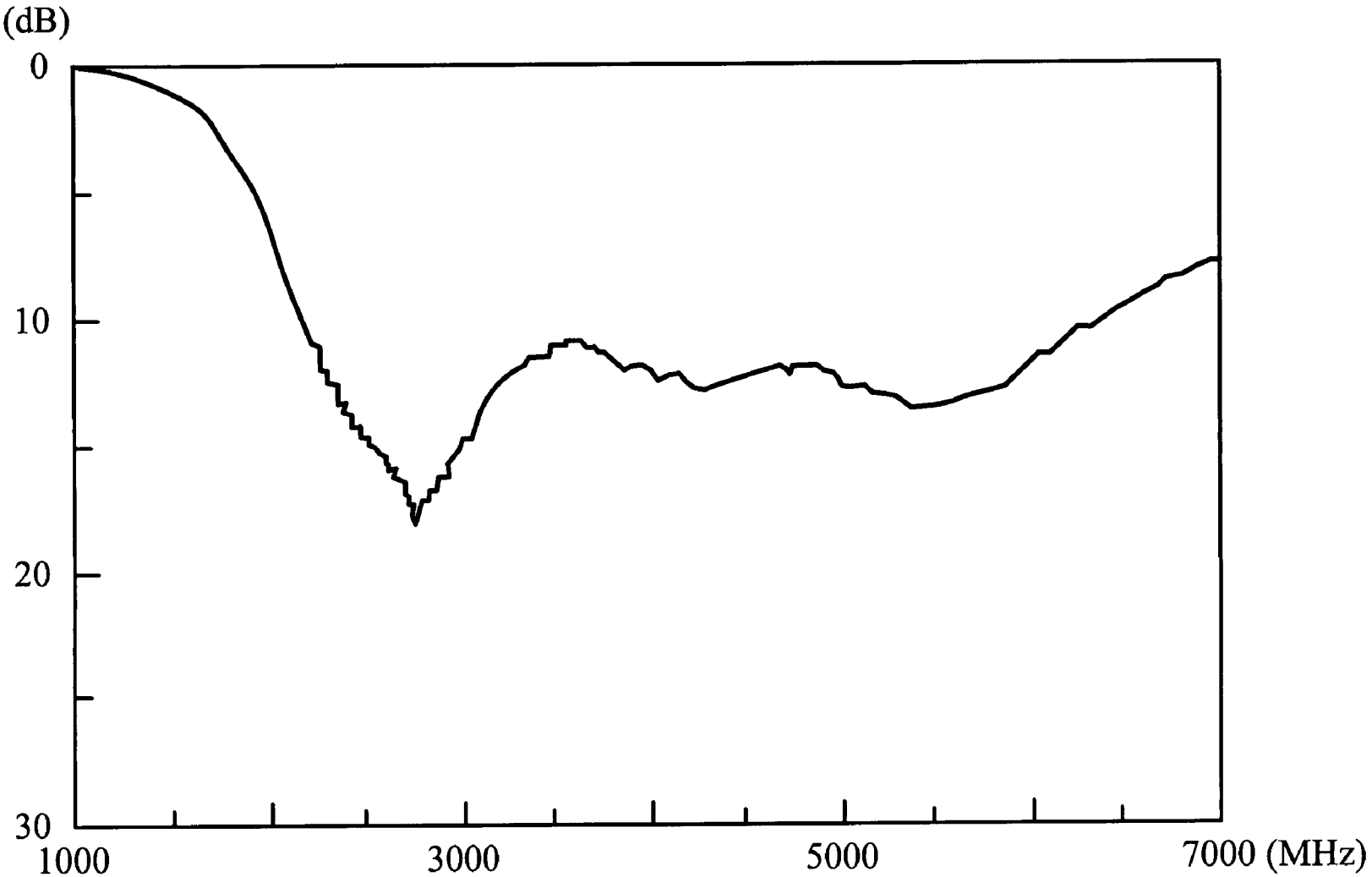
FIG. 2 is a diagram of return loss of the omnidirectional broadband monopole antenna of the first embodiment of the invention.

FIG. 2 shows return loss of the antenna of the embodiment. Vertical axis shows the return loss and horizontal operating frequency. Antenna size is determined by the rectangular first sub-radiating member 111 having length of 24 mm and width of 10 mm, rectangular second and third sub-radiating members having length of 24 mm and width of 5 mm, square ground plane having length of 100 mm with first and second angles of 90°. As shown in FIG. 2, with the bandwidth definition of 9.6 dB return loss (2:1 VSWR), the obtained impedance bandwidth ranges from 2.2 to 6.6 GHz (frequency ratio 1:3).

Figure 3A:
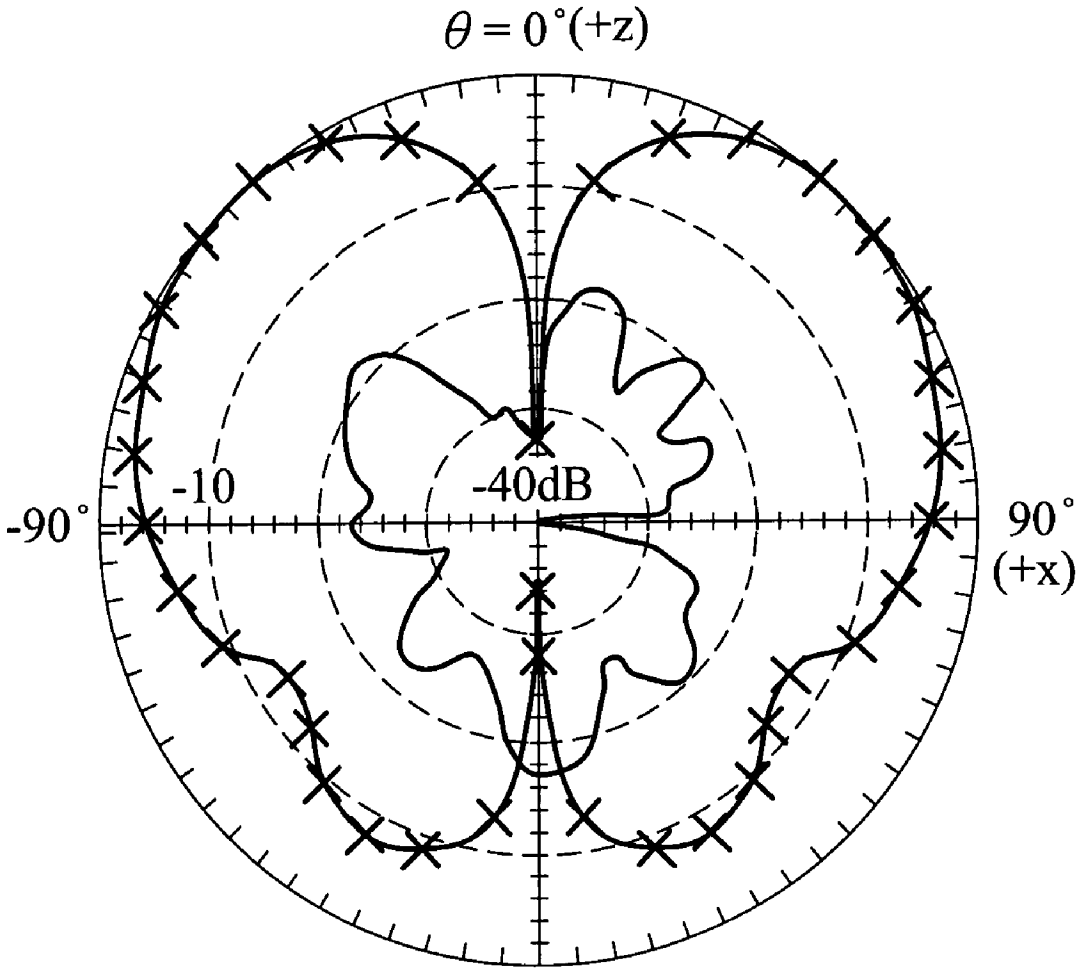
FIG. 3*a* shows the radiation pattern in x-z plane (vertical plane) of the omnidirectional broadband monopole antenna of the first embodiment of the invention at 3 GHz.
Figure 3B:
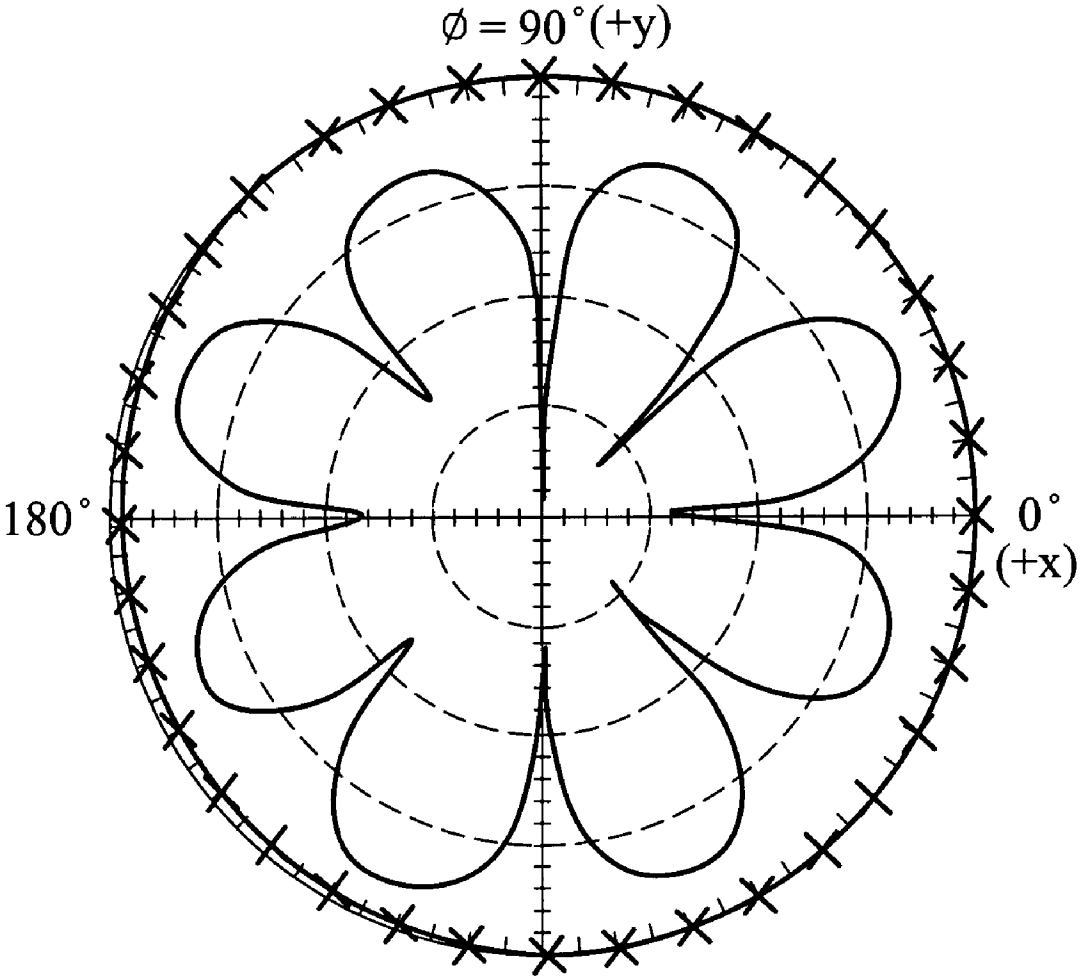
FIG. 3*b* shows the radiation pattern in x-y (horizontal) plane of the omnidirectional broadband monopole antenna of the first embodiment of the invention at 3 GHz.
Figure 3C:
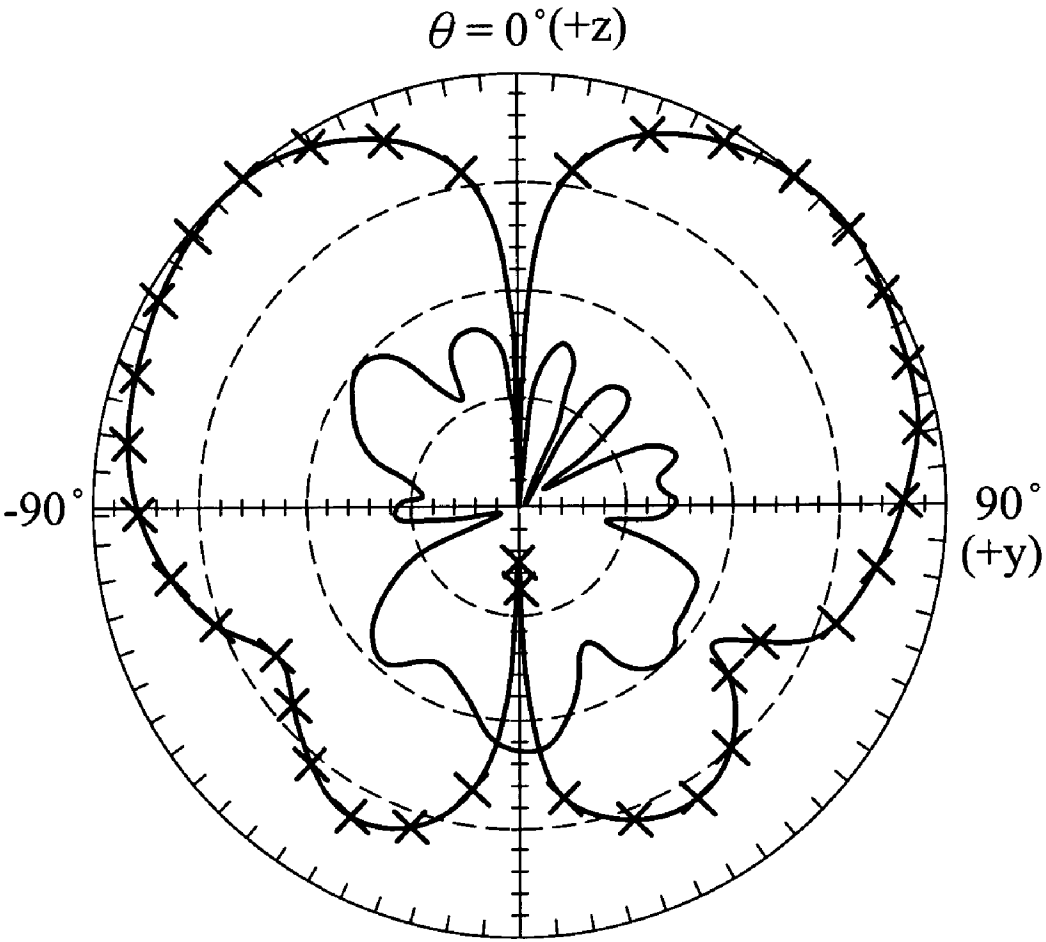
FIG. 3*c* shows the radiation pattern in y-z (vertical) plane of the omnidirectional broadband monopole antenna of the first embodiment of the invention at 3 GHz.
Figure 4A:
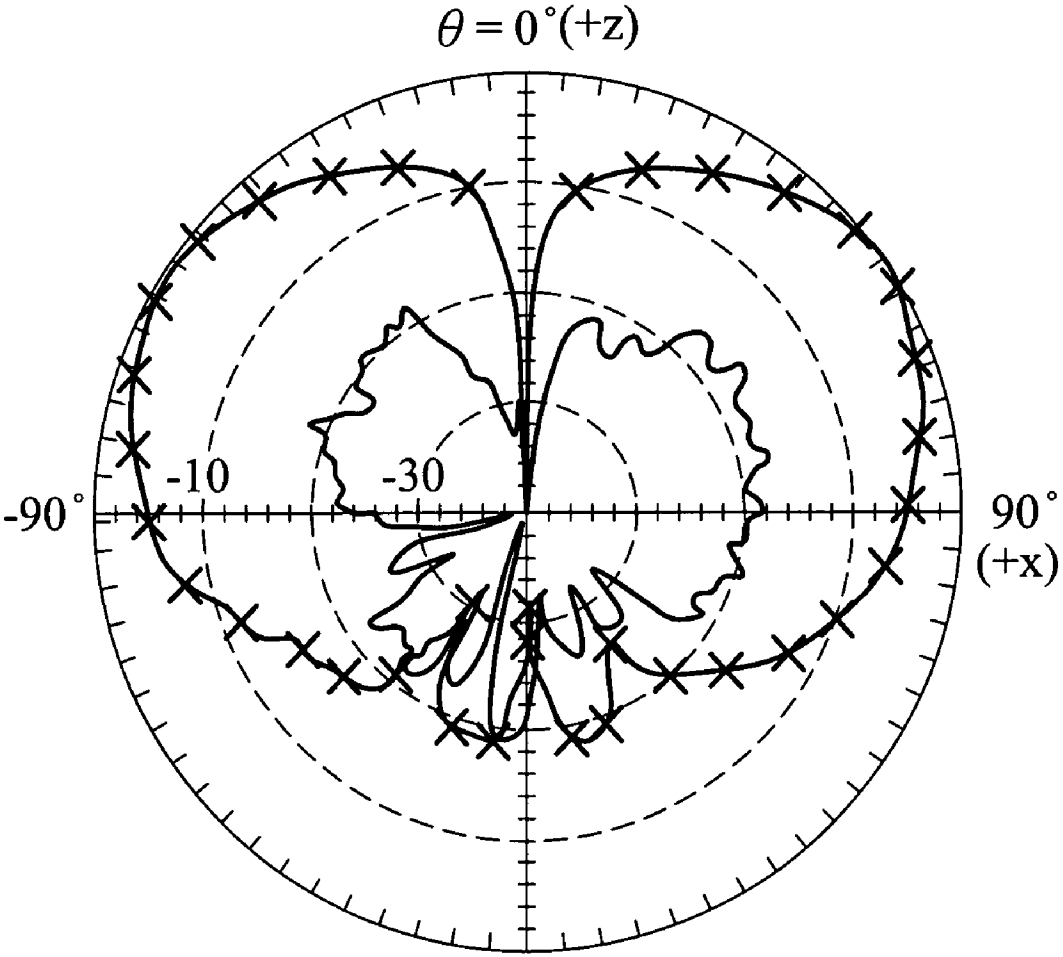
FIG. 4*a* shows the radiation pattern in x-z plane (another vertical) of the omnidirectional broadband monopole antenna of the first embodiment of the invention at 6 GHz.
Figure 4B:
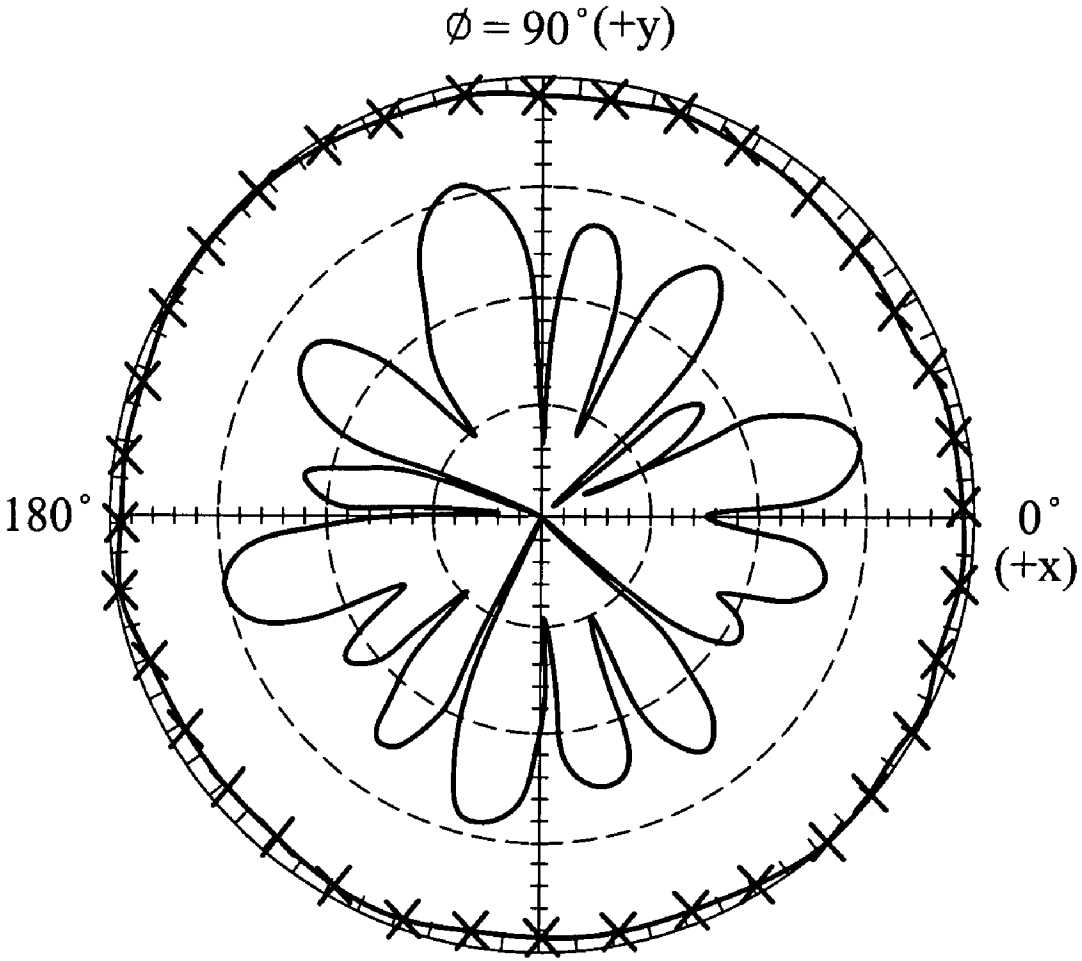
FIG. 4*b* shows the radiation pattern in x-y (horizontal) plane of the omnidirectional broadband monopole antenna of the first embodiment of the invention at 6 GHz.
Figure 4C:
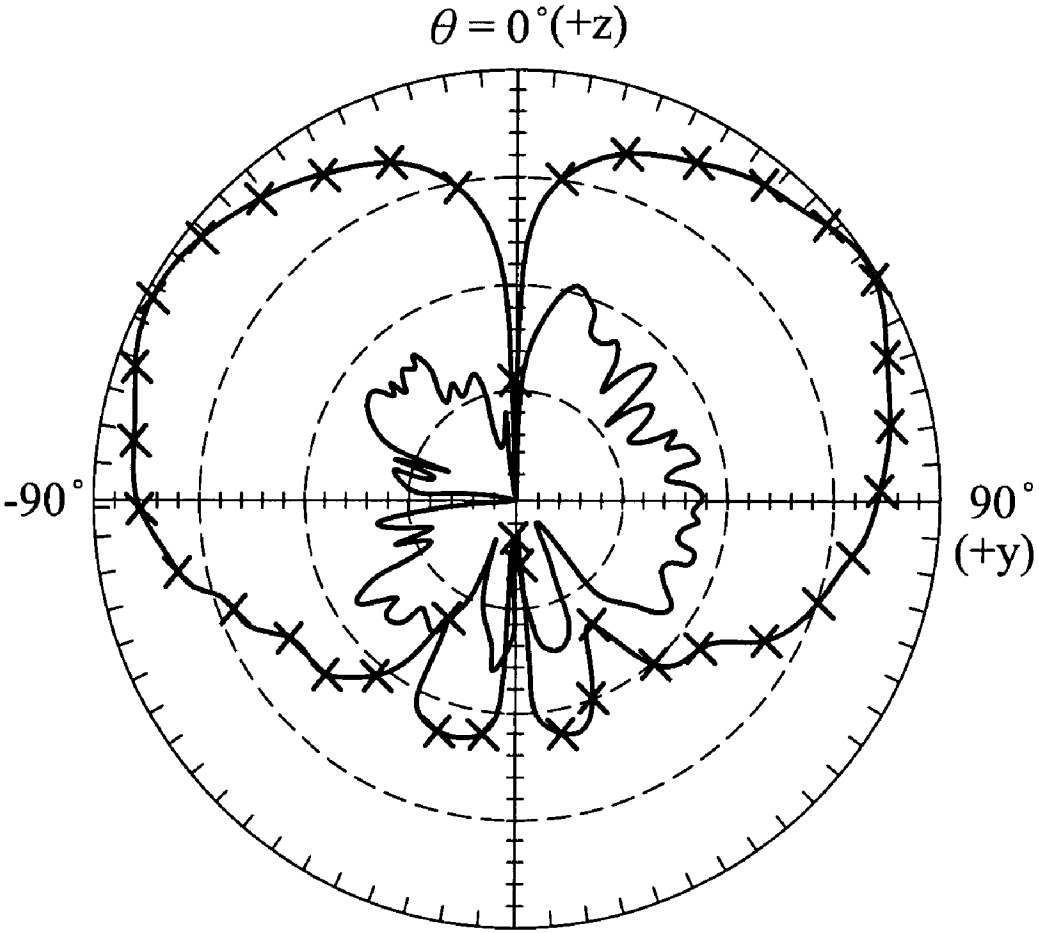
FIG. 4*c* shows the radiation pattern in y-z (vertical) plane of the omnidirectional broadband monopole antenna of the first embodiment of the invention at 6 GHz.

FIGS. 3*a* to 3*c* and 4*a* to 4*c* are radiation patterns of the omnidirectional broadband monopole antenna of the embodiment at 3000 MHz (3 GHz) and 6000 MHZ (6 GHz). θ represents angle with z axis, and ϕ the corresponding angle with x axis in the x-y plane. FIGS. 3*b* and 4*b* show radiation patterns measured in the x-y plane. In FIGS. 3*b* and 4*b*, gain variation of the radiation patterns is less than 3 dB. It was also found that, when the first and second angles are between 40° and 130°, the antenna of the invention exhibits a gain variation of horizontal radiation pattern less than 3 dB within the operating frequency range thereof.

Figure 5:
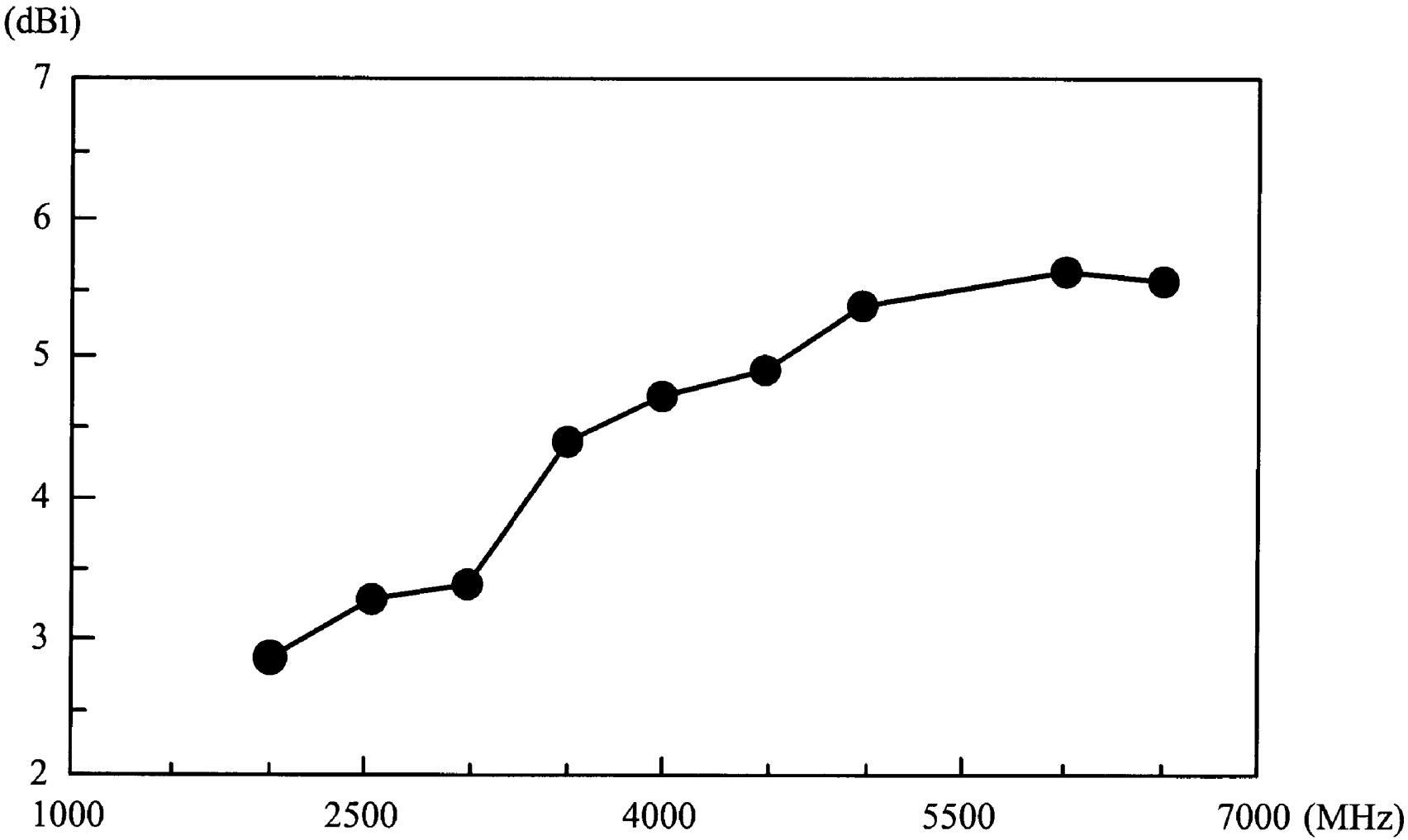
FIG. 5 is a gain diagram of the omnidirectional broadband monopole antenna of the first embodiment of the invention.

FIG. 5 shows the measured gain of the antenna of the embodiment. The measured gain within the operating frequency band ranges from 2.8 to 5.5 dBi, satisfying the requirement for wireless local area network communications.

Second Embodiment

Figure 6A:
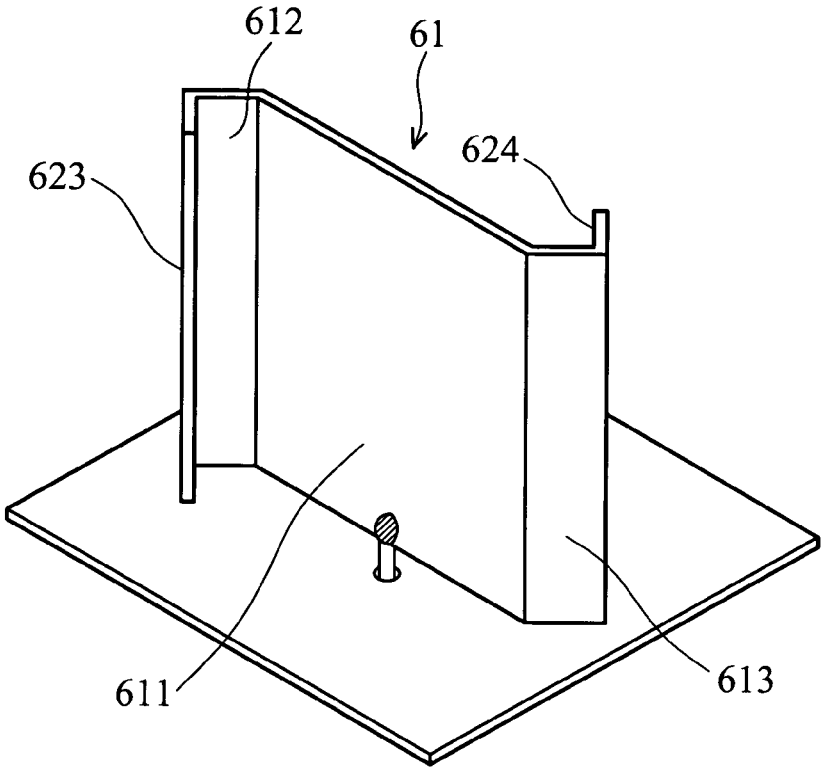
FIG. 6*a* is a perspective view of the omnidirectional broadband monopole antenna of a second embodiment of the invention.
Figure 6B:
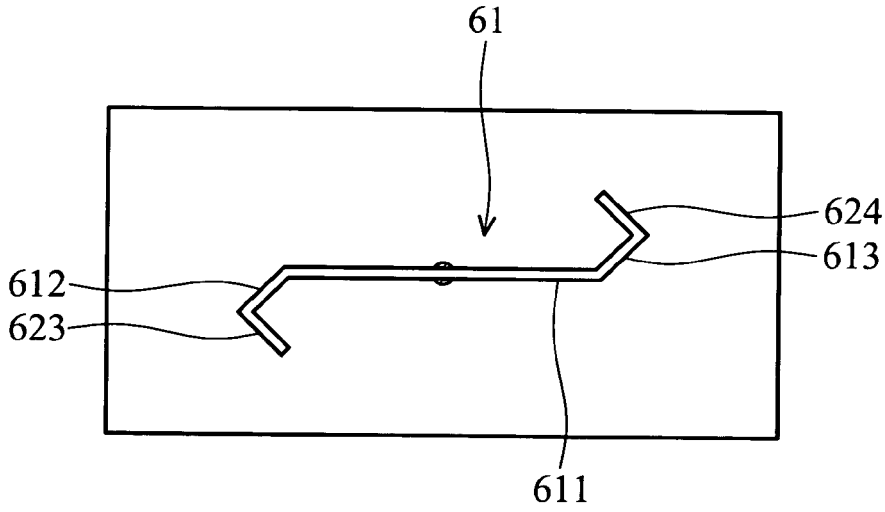
FIG. 6*b* is a top view of the omnidirectional broadband monopole antenna of the second embodiment of the invention.

FIGS. 6*a* and 6*b* show the second embodiment of the omnidirectional broadband monopole antenna of the invention. The antenna in FIG. 6*a* comprises a first sub-radiating member 611, a second sub-radiating member 612, a third sub-radiating member 613, a fourth sub-radiating member 623 connected to the second sub-radiating member 612 and a fifth sub-radiating member 624 connected to the third sub-radiating member 613. The fourth sub-radiating member 623 extends opposite to the fifth sub-radiating member 624. In FIG. 6*b*, the fourth sub-radiating member 623 has the same planar shape as the fifth sub-radiating member 624. The sub-radiating members of this embodiment can be formed by angling a metal plate or by connecting two metal plates.

Third Embodiment

Figure 7A:
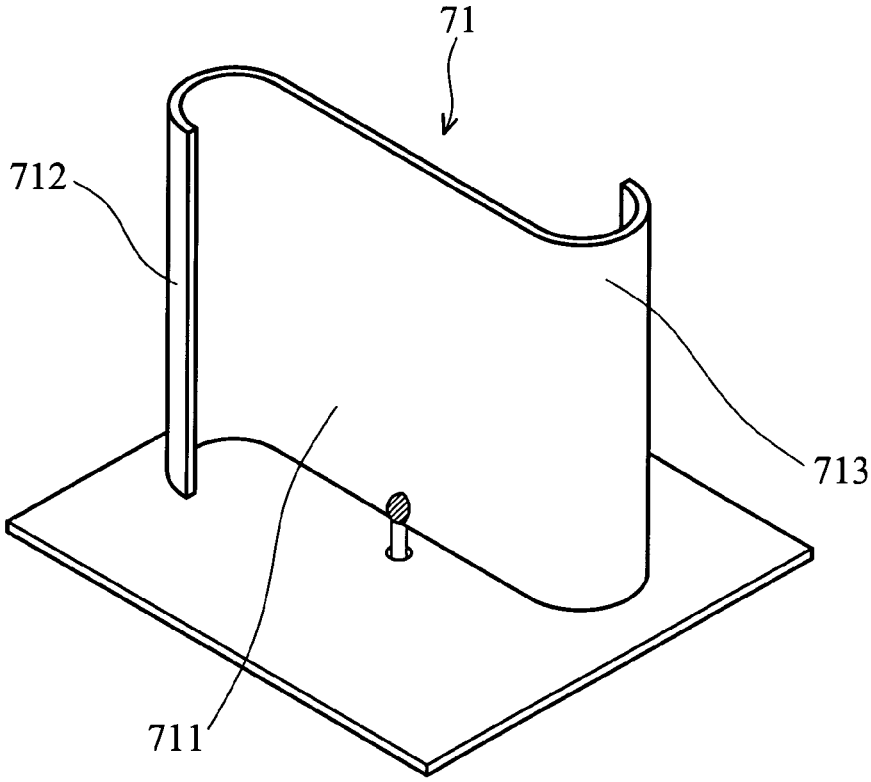
FIG. 7*a* is a perspective view of an omnidirectional broadband monopole antenna of a third embodiment of the invention.
Figure 7B:
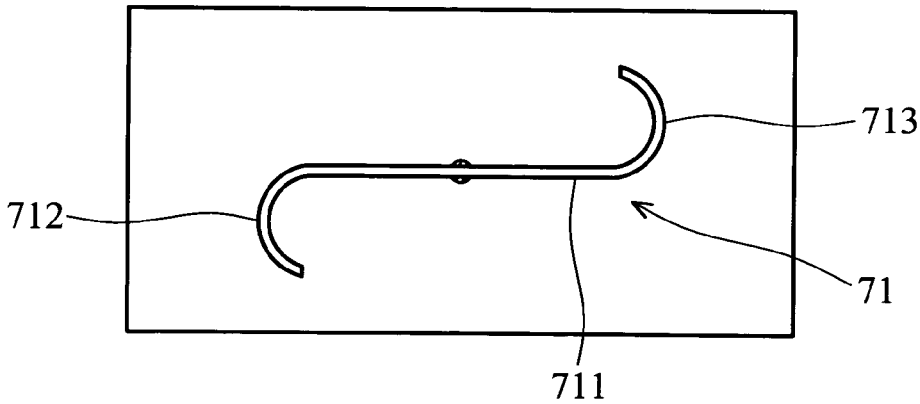
FIG. 7*b* is a top view of the omnidirectional broadband monopole antenna of the third embodiment of the invention.

FIGS. 7*a*, 7*b* show the third embodiment of the omnidirectional broadband monopole antenna of the invention. The antenna of this embodiment comprises a curved second sub-radiating member 712 and a curved third sub-radiating member 713. Other components of the antenna in FIGS. 7*a*, 7*b* are the same as the antenna in FIG. 1.

The antenna of embodiments of the invention can provide simpler manufacture and improved horizontal omnidirectional radiation pattern, for broad application in commercial communication.

While the invention has been described by way of example and in terms of the preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An omnidirectional broadband monopole antenna, comprising:

a ground plane having a via-hole;

a radiating member disposed above the ground plane and comprising a plurality of sub-radiating members, which are connected to each other side-by-side and all perpendicular to the ground plane, to provide angles; and a feed member connected to the radiating member through the via-hole without contacting the via-hole.

2. The omnidirectional broadband monopole antenna as claimed in claim 1, wherein the radiating member comprises:

a first sub-radiating member comprising a first side and a second side opposite thereto;

a, second sub-radiating member connected to the first side and extending in a first direction; and a third sub-radiating member connected to the second side and extending in a second direction.

3. The omnidirectional broadband monopole antenna as claimed in claim 2, wherein the second sub-radiating member and the third sub-radiating member are of the same shape.

4. The omnidirectional broadband monopole antenna as claimed in claim 2, wherein the first, second and third sub-radiating members are planar.

5. The omnidirectional broadband monopole antenna as claimed in claim 2, wherein a metal plate forms the first, second and third sub-radiating members.

6. The omnidirectional broadband monopole antenna as claimed in claim 3, wherein a metal plate forms the first, second and third sub-radiating members.

7. The omnidirectional broadband monopole antenna as claimed in claim 2, wherein at least two metal plates form the first, second and third sub-radiating members.

8. The omnidirectional broadband monopole antenna as claimed in claim 2, wherein the first sub-radiating member is wider than the second sub-radiating member.

9. The omnidirectional broadband monopole antenna as claimed in claim 2, wherein the first sub-radiating member is wider than the third sub-radiating member.

10. The omnidirectional broadband monopole antenna as claimed in claim 2, wherein the first sub-radiating member and the second radiating member provide a first angle between 40° and 130°.

11. The omnidirectional broadband monopole antenna as claimed in claim 2, wherein the first sub-radiating member and the third radiating member provide a second angle between 40° and 130°.

12. The omnidirectional broadband monopole antenna as claimed in claim 2, wherein the first sub-radiating member further comprises a feed point and the feed member comprises a metal rod with one end connected to the feed point through the via-hole.

13. The omnidirectional broadband monopole antenna as claimed in claim 2, wherein the radiating member further comprises a fourth sub-radiating member extending from the second sub-radiating member in a third direction and a fifth sub-radiating member extending from the third sub-radiating member in a fourth direction.

14. The omnidirectional broadband monopole antenna as claimed in claim 13, wherein the third direction is opposite to the fourth direction.

15. The omnidirectional broadband monopole antenna as claimed in claim 13, wherein the fourth and fifth sub-radiating members are planar.

16. The omnidirectional broadband monopole antenna as claimed in claim 13, wherein a metal plate provide die first, second, third, fourth and fifth sub-radiating members.

17. The omnidirectional broadband monopole antenna as claimed in claim 13, wherein at least two metal plates provide the first, second, third, fourth and fifth sub-radiating members.

18. The omnidirectional broadband monopole antenna as claimed in claim 1, wherein the ground plane is flat.

19. The omnidirectional broadband monopole antenna as claimed in claim 2, wherein the first direction is opposite to die second direction.

20. The omnidirectional broadband monopole antenna as claimed in claim 2, wherein the second and third sub-radiating members are curved.

* * * * *